United States Patent [19]

Poynton et al.

[11] 4,212,140

[45] Jul. 15, 1980

[54] APPARATUS FOR RESTORING DISTORTED ARTICLES TO THEIR TRUE CROSS-SECTIONAL SHAPE

[75] Inventors: Bertram G. Poynton, Bromham; Phillip S. Waite, Kempston, both of England

[73] Assignee: Ti Fords Limited, Kempston, England

[21] Appl. No.: 32,271

[22] Filed: Apr. 23, 1979

[51] Int. Cl.[3] ..... B65B 7/28; B65B 63/02; B21D 1/06

[52] U.S. Cl. ..... 53/289; 53/486; 100/177; 113/120 M; 141/168

[58] Field of Search ..... 53/289, 486, 300, 367; 113/120 M; 100/177; 141/114, 168

[56] References Cited

U.S. PATENT DOCUMENTS

| | | | |
|---|---|---|---|
| 1,099,756 | 6/1914 | Malmquist | 53/289 X |
| 2,660,936 | 12/1953 | Livacich et al. | 53/289 X |

*Primary Examiner*—Travis S. McGehee
*Attorney, Agent, or Firm*—Brisebois & Kruger

[57] ABSTRACT

Containers having their bodies made from laminate material, such as paper board/plastic foil/metal foil laminates, readily tend to distort and this results in unreliable application of metal foil closure caps used to seal the mouths of the containers. The present invention provides apparatus for successively advancing cylindrical containers of this type beneath a cap-applying device and for restoring distorted containers to their true circular cross-sectional to enable correct application of the caps to the container mouths. The apparatus comprises two star wheels, having equal pitch circle diameters, which are mounted side-by-side with their axes of rotation parallel and spaced apart by a distance less than the common pitch circle diameter of the two wheels. The latter have equal numbers of part-circular recesses in their peripheries for engaging containers. On one of the star wheels the recesses are fixed while the other is constructed so that the recesses are radially displaceable and are resiliently urged into their radially outermost positions in which their centers of curvature lie on the pitch circle of the star wheel. The star wheels are rotated in opposite directions at substantially equal speeds and so that the recesses are successively disposed in mutually opposed relation. The containers are fed between the star wheels which successively advance them beneath the cap-applying device. Each container is resiliently clamped between opposing recesses as it is advanced beneath the cap-applying device and this serves to restore a distorted container to its true circular cross-sectional shape.

10 Claims, 4 Drawing Figures

APPARATUS FOR RESTORING DISTORTED ARTICLES TO THEIR TRUE CROSS-SECTIONAL SHAPE

BACKGROUND OF THE INVENTION

The present invention relates to apparatus for restoring distorted articles, such as containers, which are of nominally circular cross-section, to their true circular cross-sectional shape. Particularly, the invention relates to apparatus for successively advancing distortable articles of nominally circular cross-section through a processing station and at least temporarily restoring each distorted article to its circular cross-sectional shape whilst a predetermined operation is performed in connection with the article as it is advanced through the station. More particularly, although not exclusively, it relates to apparatus for ensuring that distortable containers of nominally circular cross-section are of true circular cross-sectional shape as they are advanced through a station at which closures are applied to the mouths of the containers.

Cylindrical or frusto-conical containers having outwardly directed flanges or rolled beads about the mouths of the containers are frequently closed by the application to the mouth of each container of a closure cap made from metal foil. Such a cap is provided with a shallow cylindrical skirt having an internal diameter slightly greater than the external diameter of the mouth of the container. The lower portion of the skirt may be mechanically crimped or swaged under the flange or rolled bead about the mouth of the container to secure the cap in position. Additionally, the cap may be heat-sealed to the rim of the container mouth by providing the metal foil from which the cap is made with a coating of thermoplastic resin adhesive or a plastics film compatible with the container material and applying heat and pressure to the cap, when located on the container mouth, by means of a heated platen. This type of container/closure combination is widely used in the dairy industry for packaging products, such as yoghurt and cream, and for these products, the container is made by vacuum-forming or injection moulding thermoplastics material, such as, polystyrene or polypropylene. The external diameter of the mouths of such containers can be maintained to close tolerances and the mouth will retain its circular shape after manufacture and during storage and transportation to the packaging plant. Therefore, caps can be reliably applied to such containers by automatic machinery and only require a slightly greater diameter than the container mouth to ensure correct, distortion-free application. A typical clearance between cap and container diameters is of the order of from 0.010 inches to 0.020 inches.

The economy and easy-of-opening characteristics of foil caps make these attractive for use with other types of containers, such as, those manufactured from various laminated combinations of paper board, aluminium foil and thermoplastics film. For example, one type of cylindrical container body is produced by wrapping a rectangular piece of laminated material about a cylindrical mandrel and sealing the overlapped edges with adhesive or by firmly welding plastic films on each side of the laminate. Alternatively, cylindrical container bodies may be manufactured by spirally winding one or more continuous lengths of a suitable laminate material on a cylindrical mandrel and thereafter cutting the resulting tube into container bodies of the required length. In either event, the end of the container body which will form the mouth of the container to be subsequently sealed by a metal foil cap, may be reinforced by rolling an outwardly turned bead about this end of the container body.

Containers made from laminate material by either of the above methods are dimensionally unstable and readily become distorted from their true circular cross-sectional shapes. This can cause considerable problems and unreliable or defective application of closures when thin foil caps are applied by automatic machinery.

Hence, there is a need for apparatus which will ensure that cylindrical or frusto-conical containers made from laminate material are of truly circular cross-sectional shape when they are fed through automatic capping machinery and which will restore distorted containers to their nominal shape, at least temporarily, whilst the caps are being applied.

SUMMARY OF THE INVENTION

Apparatus for successively advancing distortable articles of nominally circular cross-section through a processing station and for restoring distorted articles to their circular cross-sectional shape, at least temporarily whilst they are processed, comprises two star wheels which are mounted side-by-side with their axes of rotation substantially parallel. These star wheels have part-circular recesses in their peripheries for engaging opposite sides of the containers successively fed into engagement therewith, the part-circular recesses of each star wheel having their centres of curvature disposed on the pitch circle of the star wheel. At least one of the star wheels is constructed so that its part-circular recesses are displaceable radially inwardly of the star wheel and are resiliently urged into their radial outermost positions in which their centres of curvature are disposed on the pitch circle of the star wheel. The star wheels are rotatable in opposite directions at substantially equal peripheral speeds and so that the recesses are successively disposed in mutually opposed relation. The axes of rotation of the star wheels are spaced apart by a distance less than the sum of the radii of their pitch circles and, therefore, when each article is advanced between the wheels, it is resiliently clamped within opposing recesses and these restore a distorted article to its circular cross-sectional shape, at least for the period that it remains clamped between the recesses.

In a preferred embodiment of the invention, the star wheels have substantially equal pitch circle diameters and their axes of rotation are spaced apart by a distance less than the common pitch circle diameter. One of the star wheels has fixed part-circular recesses for engaging the articles whilst the recesses of the other star wheel are radially displaceable. These diaplaceable recesses are formed at the peripheral ends of radially slidable members forming part of the star wheel. The slidable members are mounted on hub means fixed to a shaft for rotating the star wheel. Each member has a pin engaged in a radial slot in the hub means and, conversely, the hub means has pins engaged, respectively, in radial slots in the slidable members. The arrangement of these pins and slots guides the slidable members for movement in a radial direction. Spring means disposed between the pins resiliently urges the slidable members radially outwardly into the position in which the centres of curvature of the associated part-circular recesses define the pitch circle of the star wheel. The slot in each slidable member may be wider than the diameter of its associated pin so as to permit the member a small amount of lateral movement to facilitate engagement of the associated recess with an article advanced into engagement with the star wheels. Means may be provided for indexing each slidable member into a centred position when it is not engaged with an article and is urged into its radially outermost position.

The apparatus according to the invention is particularly suitable for feeding distortable containers, such as those formed from paper board/metal foil/plastics foil laminate material, beneath a device for automatically applying metal foil closure caps to the mouths of the containers. In such machinery, the star wheels are arranged to advance the containers successively beneath the cap-applying device which deposits a cap over the mouth of each container, whereafter each container, together with the cap thereon, is fed to heat sealing and crimping heads for securing the cap in position.

Accordingly, it is an object of the present invention to overcome the problems previously experienced in processing cylindrical or frusto-conical articles, especially containers, of a distortable nature and thereby enable such articles to be made of thinner gauge material. It is another object of the invention to provide apparatus for successively advancing distortable articles of nominally circular cross-section through a processing station and for restoring distorted articles to their circular cross-sectional shape, at least temporarily, whilst they are advanced through the station and an operation is being effected thereon. It is yet another object of the invention to provide apparatus for successively advancing cylindrical or frusto-conical containers, which have their bodies made from distortable laminate material, beneath a device for applying foil closures to the mouths of the containers, which apparatus also restores distorted containers to their truly circular cross-sectional shape, at least temporarily whilst the containers are advanced underneath the closure-applying device so that the closures are properly deposited in position on the mouths of the containers.

These and other objects and advantages of the invention will be apparent from the following description, accompanying drawings and appended claims.

DETAILED DESCRIPTION OF THE PREFERRED EMBODIMENT

Figure 1:
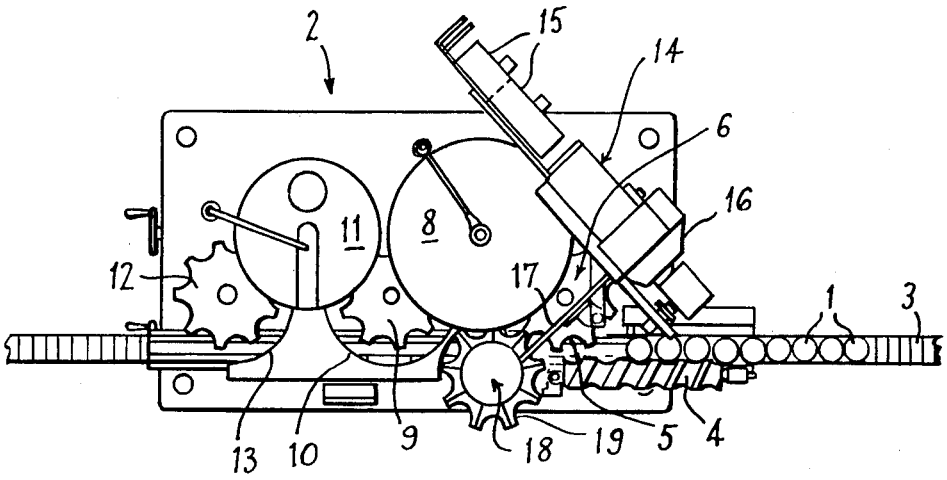
FIG. 1 is a plan view of a machine embodying the invention for sealing the mouths of containers with closure caps.

Referring to FIG. 1 of the accompanying drawings, cylindrical containers 1 which are to be closed by metal foil caps sealed over the mouths of the containers are transported to the capping machine 2 on a slat conveyor 3 with their mouths uppermost. They are fed from the conveyor into the machine by a helical feed screw 4 which spaces the containers apart by the required pitch for feeding through the rotary elements of the machine. At its exit end, the feed screw feeds the containers tangentially into successive recesses 5 of a continuously rotating first star wheel 6 which, in conjunction with a guide rail 7 (FIGS. 2 and 3), moves the containers in a circular path and onto pedestals mounted in the rotating turret 8 of a first multi-head sealing unit. As each container is moved onto a pedestal, it is disengaged from the recess 5 in the star wheel 6 and is thereafter advanced about the turret on the pedestal which raises the container into contact with the associated sealing head to effect a first cap sealing operation, as the turret rotates. At the end of the first sealing operation, which occurs over only a part of one revolution of the turret, a second star wheel 9 cooperates with an arcuate guide 10 to transfer the containers from the pedestals of the turret 8 onto similar pedestals in the rotating turret 11 of a second multi-head sealing unit. After being advanced about this second sealing unit, which effects a second cap sealing operation over a part of one revolution of the turret 11, a third star wheel 12, in conjunction with an arcuate guide 13, transfers the containers back onto the conveyor 3 for discharge from the machine.

Closure caps are deposited on the mouths of the containers 1 as they are fed into the turret 8 by the first star wheel 6. A cap making tool 14 is mounted above the machine and includes supply and take-up spools 15 for metal foil strip and for waste strip, respectively, and a press section 16 which stamps out caps from the strip advanced from the supply reel. The caps produced by the press are discharged into a chute 17 which terminates in a cap-applying device (not shown) for depositing the caps successively on the containers as they are fed underneath the device by the first star wheel 6 and in a position between the points at which the containers are transferred from the feed screw 4 into the star wheel 6 and from the latter onto the pedestals in the turret 8.

The first sealing turret 8 may be adapted to effect mechanical crimping of the closure caps onto the containers 1 and the second turret 11 may be adapted to heat seal the caps in position. Alternatively, the heat sealing operation may be performed by the first turret and the mechanical crimping by the second turret.

The machine as described above is of known construction and no further description thereof is believed necessary for the understanding of the present invention. With this known machine, there is no difficulty in applying light gauge metal foil caps, which are typically made from 0.002 inch thick aluminium foil strip, to relatively rigid containers, such as injection moulded plastics containers, having truly circular mouths. However, with distortable containers, such as those made from paper board laminate, serious distortion of the mouth is common and results in faulty cap application.

According to the present invention, in order to avoid faulty cap application when the machine is used for sealing distortable containers, a further star wheel 18 of the special construction to be hereinafter described is mounted to cooperate with the first star wheel 6 so that the cooperating recesses 5,19 of these two star wheels restore the mouth of a distorted container to a truly circular configuration and maintain this condition at least for a sufficient arc of movement of the star wheel 6 to permit a cap to be correctly applied to the container mouth.

Figure 2:
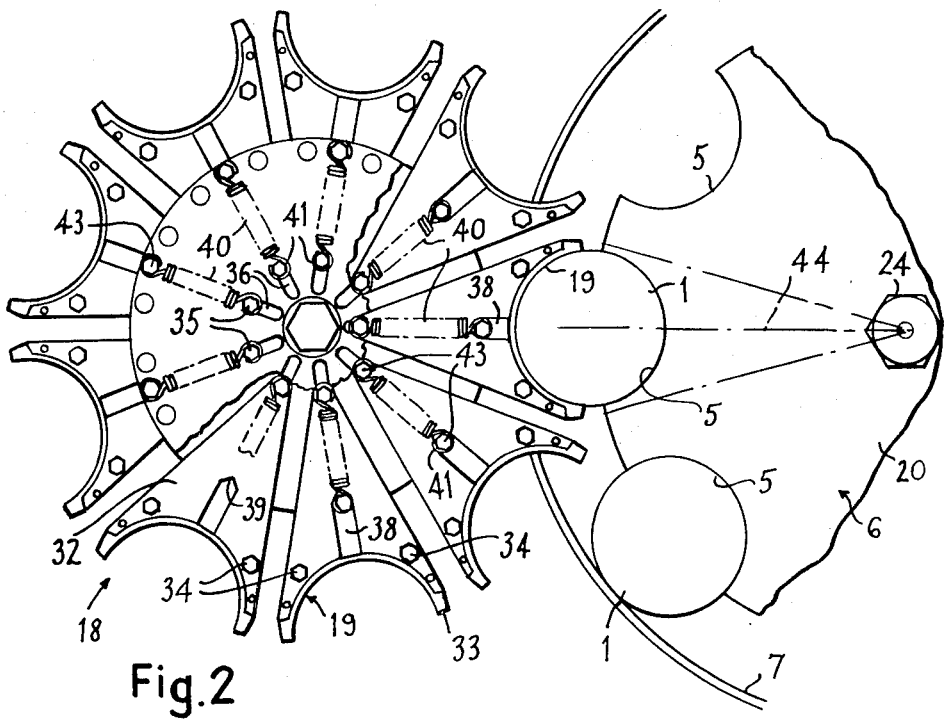
FIG. 2 is an enlarged fragmentary plan view, partially in section, of the apparatus for restoring the containers to their true circular cross-sectional shape.
Figure 3:
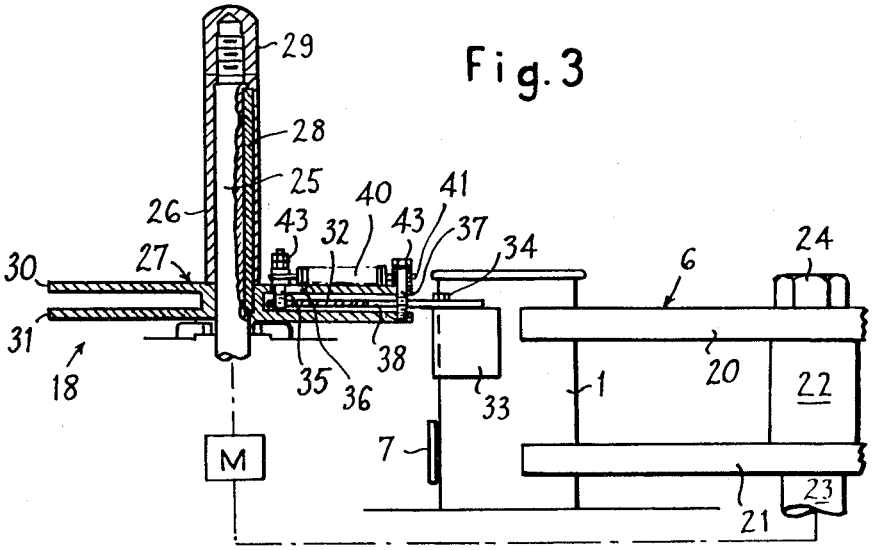
FIG. 3 is a side elevation, partially in section, of the apparatus shown in FIG. 2.

Referring to FIGS. 2 and 3 of the drawings, the first star wheel 6 comprises two horizontal discs 20,21 spaced one above the other at opposite ends of a hub 22 which is keyed to a vertical shaft 23 for rotating the star wheel and is retained on the shaft by means of a nut 24. The discs 20,21 have aligned part-circular recesses 5 in their peripheries, each of which recesses has a radius of curvature substantially equal to the external radius of the cylindrical containers 1 to be advanced by the star wheel 6. Preferably, the recesses 5 are nearly semi-circular in shape. The centres of curvature of the recesses 5 lie on a common circle, which is known as the pitch circle of the star wheel. The latter cooperates with the arcuate guide rail 7 in order to advance the containers along an arcuate path from the exit end of the feed screw 4 to the first sealing turret 8.

Figure 4:
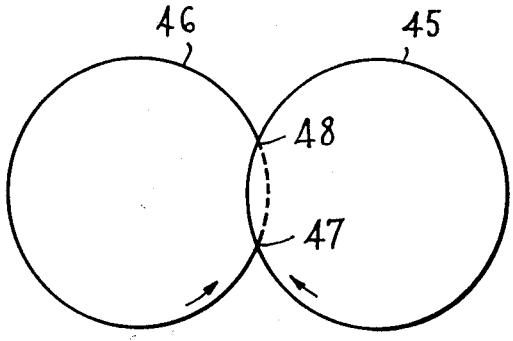
FIG. 4 is a diagrammatic plan view illustrating the relative positions of the pitch circles of the two star wheels of the apparatus shown in FIGS. 2 and 3.

The star wheel 18 is of composite construction having the same number of peripheral recesses 19 as the star wheel 6 and the same pitch circle diameter. It is mounted on a vertical shaft 25 which has its axis spaced from the axis of the shaft 23 by a distance slightly less than the common pitch circle diameter of the star wheels 6,18, as shown in FIG. 4. The star wheel 18 comprises a sleeve 26 carrying a hub member 27 at its lower end. Both the sleeve and the hub member are keyed to the shaft 25 by means of a key 28 and are secured on the shaft by a cap nut 29. The hub member comprises two vertically spaced horizontal discs 30,31 supporting a radial array of slidable members in the form of sector-shaped plates 32, each of which has one of the part-circular recesses 19 formed at its wider peripheral end. Each recess 19 is similar in shape to a recess 5 and is also defined by a part-cylindrical member 33 secured in a verical position beneath the cooperating recess in the end of the associated plate by means of bolts 34. The radius of curvature of each recess 19 is equal to the radius of curvature of each recess 5 in the star wheel 6.

The sector-shaped plates 32 are slidably mounted between the discs 30,31 of the hub member 27. These discs are spaced apart by a sufficient distance to permit the plates 32 to move freely whilst confining them to movement in a horizontal plane. Low friction coatings or layers may be applied to the upper and lower surfaces of each plate to facilitate smooth movement thereof and reduce wear. Each plate 32 has an inner guide pin 35 at its inner end engaged in a radial slot 36 formed in the upper disc 30 of the hub. An outer guide pin 37 fixed between the upper and lower discs adjacent their peripheries extends through a radial slot 38 in each plate adjacent its end. Each slot 38 is wider than its associated guide pin and is terminated at its inner end 39 by a "V" shape which serves to centre the plate with respect to the guide pin 37 when the plate is urged into its outermost radial position. The two guide pins 35,37 and their associated slots guide each sector-shaped plate for radial sliding movement whilst the clearance between the outer guide pin 37 and its slot 38 permits the plate to swivel laterally to a small extent about the inner guide pin 35. In its outermost position, this swivelling movement of the sector-shaped plate is prevented by the guide pin 37 engaging in the V-shaped end of the associated slot 38.

The guide pins project above the upper disc 30 and mounted between the projecting ends of each pair of guide pins 35,37 is a tension spring 40. Eyes 41 at oppostie ends of each tension spring are threaded over the pins and are secured in position by nuts 43 screwed onto the upper ends of the pins. These tension springs resiliently urge the sector-shaped plates 32 into their radially outermost positions in which the outer guide pins 37 engage in the V-shaped ends 39 of the slots 38. When the sector-shaped plates are in their outermost positions, the centres of curvature of the part-circular recesses 19 lie on a common circle which is the pitch circle of the star wheel 18, the diameter of which circle is equal to the pitch circle diameter of the star wheel 6.

In operation, the two star wheels 6,18 are driven in opposite directions, at the same angular velocity, by the motor M of the machine which is coupled to the shafts 23,25 in any suitble manner, and the rotation of the star wheels is also synchronised so that when the centre of curvature of a recess 5 in the star wheel 6 is positioned on the imaginary line 44 joining the axes of rotations of the two wheels, the centre of curvature of a recess 19 on the star wheel 18 is also disposed on this imaginary line. The containers 1 to be closed are successively fed into engagement with the recesses in the star wheel 6 and the guide rail 7 engages the body of each container to ensure that the latter is retained in its recess in this star wheel as it rotates. In FIG. 2, a container 1 is shown centered on the imaginary line 44 joining the axes of rotation of the two star wheels. As mentioned above, the star wheels 6,18 are located on the machine with their centres of rotation spaced apart by a distance less than the common pitch circle diameter of the star wheels, as shown in FIG. 4, wherein 45 is the pitch circle of the star wheel 6 and therefore represents the locus of the path followed by the axis of each container advanced by this star wheel. 46 represents the pitch circle of the star wheel 18 when the sector-shaped plates and recesses 19 are in their radially outermost positions. The two pitch circles 45,46 intersect at 47 and 48. Hence, when each container is at point 47, most of its circumference is resiliently clamped or contained within the two circular arcs formed by opposing star recesses 5,19 and, since the centres of these recesses are then coincident, they define a truly circular opening which restores a deformed or distorted container body to its true circular cross-section. This condition is maintained for the whole of the length of the arc 47–48. During movement of each container along the arc 47–48, the associated sector-shaped plate 32 and recess 19 engaged with the container body, move radially inwardly of the star wheel 18 against the action of the associated spring 40 and the plate swivels slightly about its inner guide pin 35 so that the recess 19 can follow the container along the arc 47–48. The length of this arc is determined by the amount by which the axis-to-axis distance of the star wheels 6,18 is less than the common pitch circle diameter thereof. For example, with star wheels having nine recesses 5,19 disposed on a pitch circle diameter of 16 inches and having their axes spaced apart by 15½ inches, the intersection arc 47–48 subtends an angle of approximately 29° at the centre of the star wheel 6 and this is more than sufficient to start and complete the application of a cap to the mouth of the container, the cap being deposited onto the container mouth by the cap-applying device at the end of the chute 17. During the period that a container body is engaged between recesses 5,19, the sector-shaped plate 32 swivels by less than ½° either side of its central position as it follows the container.

In practice, it has been found that correct cap application can be achieved at a high rate, for example, 200 containers per minute, even on containers so severely distorted that the container mouths, instead of being circular, are eliptical with maximum and minimum diameters in the ratio of 2:1.

Whilst a particular embodiment has been described, it will be understood that modifications can be made without departing from the scope or spirit of the invention. Moreover, although the preferred embodiment of the invention has been described with reference to the sealing of metal foil caps to the mouths of containers made from laminate material, it will be appreciated that it has many other applications where dimensionally unstable or flimsy articles have to be restored to a true circular shape for processing whilst being advanced through the processing station.

What is claimed is:

1. Apparatus for successively advancing distortable articles of nominally circular cross-section and for restoring distorted articles, at least temporarily, to their circular cross-sectional shape, comprising:

(a) two star wheels mounted side-by-side with their axes of rotation substantially parallel, (b) means defining cooperating part-circular recesses in the peripheries of said star wheels, (c) said part-circular recesses in each said star wheel having centres of curvature disposed on the pitch circle of the siad star wheel, (d) said recess defining means on at least one of said star wheels being radially displaceable and being resiliently urged into radially outermost positions in which said centres of curvature of the associated recesses are disposed on said pitch circle of the star wheel, and (e) means rotating said star wheels in opposite directions at substantially equal peripheral speeds, such that said recesses in said two star wheels are successively disposed in mutually opposed relation, whereby each article advanced between said star wheels is resiliently clamped between opposing ones of said recesses which serve to restore said article to its circular cross-sectional shape.

2. Apparatus as claimed in claim 1, wherein said axes of rotation of said star wheels are spaced apart by a distance less than the sum of the radii of the pitch circles of said star wheels.

3. Apparatus as claimed in claim 1, wherein said star wheels have substantially equal pitch circle diameters.

4. Apparatus as claimed in claim 1, wherein said radially displaceable recess defining means is adapted also to swivel slightly when said means is engaged with an article.

5. Apparatus as claimed in claim 1, wherein said recess defining means on one of said star wheel is radially displaceable and said recess defining means on the other of said star wheels if fixed.

6. Apparatus as claimed in claim 1, wherein sadi radially displaceable recess defining means comprises a radial array of slidable members mounted on the associated star wheel and having recesses 1 disposed at the peripheral ens of said members, and spring means resiliently urges said members into said radially outermost position.

7. Apparatus as claimed in claim 6, including (a) hub means supporting said slidable members, (b) a pin projecting from each slidable member and engaged in a radial slot in said hub means, (c) a pin projecting from said hub means and engaged in a radial slot in said slidable member, and (d) spring means disposed between said pins and urging said slidable member radially outwardly.

8. Apparatus as claimed in claim 7, wherein said slot in said slidable member is wider than the diameter of the associated pin to permit lateral swivelling movement of said slidable member, and the end of said slot engaged by said pin, when said member is in its outermost position, is V-shaped so as to centralise said member.

9. Apparatus as claimed in claim 1, wherein:

(a) said star wheels have substantially equal pitch circle diameters, have equal members of said recesses and have their axes of rotation spaced apart by a distance less than the common pitch circle diameter of said star wheels, (b) said recess defining means on one of said star wheels is adapted to be radially displaceable whilst that on the other of said star wheels is fixed, (c) said recess defining means are arranged to engage each container at least adjacent its mouth, (d) said star wheel having said radially displaceable recess defining means comprises a radial array of sector-shaped members having said recesses disposed at the wider, peripheral ends thereof, respectively, and slidably mounted in hub means.

(e) each sector-shaped member has an inner pin projecting therefrom adjacent its inner end and engaged in an inner radial slot in said hub means, (f) each sector-shaped member has an outer radial slot therein adjacent its peripheral end engaged by a pin projecting from said hub means, (g) tension spring means is connected between each pair of inner and outer pins and resiliently urges each sector-shaped member into its radially outermost position, (h) said outer radial slot in each sector-shaped member is wider than the diameter of its associated outer pin, whereby to permit said sector-shaped member a small amount of lateral swivel about its inner pin (i) the inner end of each outer radial slot is V-shaped, whereby to cooperate with said outer pin and centralise the associated sector-shaped member when in its outermost position.

10. In combination with a machine for sealing caps over the mouths of containers, apparatus as claimed in claim 1 in which said star wheels are arranged to advance the containers successively beneath a device for applying a metal foil cap to the mouth of each container whilst the container is being advanced between the star wheels.

* * * * *